United States Patent [19]

Menn et al.

[11] Patent Number: 4,896,962

[45] Date of Patent: Jan. 30, 1990

[54] SYSTEM FOR MEASURING THE ANGULAR DISPLACEMENT OF AN OBJECT

[75] Inventors: Anatoly Menn; Joseph Krimerman, both of Haifa, Israel

[73] Assignee: El-Op Electro Optics Industries, Ltd., Rehovot, Israel

[21] Appl. No.: 199,284

[22] Filed: May 26, 1988

[30] Foreign Application Priority Data

Jun. 1, 1987 [IL] Israel ..... 82731

[51] Int. Cl.[4] ..... G01C 1/00; G01J 1/20

[52] U.S. Cl. ..... 356/152; 250/203 CT; 250/203 R; 356/1

[58] Field of Search ..... 356/1, 141, 152; 250/203 CT, 203 R; 358/107

[56] References Cited

U.S. PATENT DOCUMENTS

| | | | |
|---|---|---|---|
| 4,111,555 | 9/1978 | Ellis | 356/141 |
| 4,193,689 | 3/1980 | Reymond et al. | 356/152 |
| 4,314,761 | 2/1982 | Reymond et al. | 356/141 |
| 4,315,690 | 2/1982 | Trocellier et al. | 356/152 |
| 4,475,814 | 10/1984 | Marche | 356/152 X |
| 4,534,650 | 8/1985 | Clerget et al. | 356/1 X |
| 4,652,917 | 3/1987 | Miller | 356/152 X |

*Primary Examiner*—Thomas H. Tarcza
*Assistant Examiner*—Linda J. Wallace
*Attorney, Agent, or Firm*—Browdy and Neimark

[57] ABSTRACT

An improved helmet line of sight measuring system for determining the spatial location of a helmet and the line of sight of an observer wearing the helmet, both relative to a coordinate reference frame. A plurality of assemblies of light sources are distributed on the helmet each comprising three light sources positioned at the vertices of a triangle and a fourth light source outside the plane of the triangle. Optical means fixed in space relative to the coordinate reference frame image the light emitted by the light sources in at least one of the assemblies onto an area image sensor, thereby producing two-dimensional image data of the light sources on the plane of the image sensor. Computing means coupled to the area image sensor is thereby able to determine the spatial coordinates of the helmet from the image data.

6 Claims, 3 Drawing Sheets

SYSTEM FOR MEASURING THE ANGULAR DISPLACEMENT OF AN OBJECT

FIELD OF THE INVENTION

This invention relates generally to the determination of the angular displacement of an object relative to a coordinate reference frame. In particular, it relates to helmet sight systems wherein the line of sight of a pilot is determined from a determination of the spatial location of the pilot's helmet. This information can then be used together with suitable control means to permit a missile, for example, automatically to be directed towards a target simply by means of a pilot looking towards the target.

BACKGROUND OF THE INVENTION

Various proposals have been made to enable information to be obtained concerning the position of a helmet in space to be used for automatic sighting of a missile. Thus, it is known to provide on the helmet radiation sources which are arranged to emit radiation which can be intercepted by sensing means coupled to suitably programmed computing means so as to determine the line of sight of the helmet. U.S. Pat. No. 4,111,555 (Elliott Brothers (London) Ltd.), for example, describes such a system wherein there are provided on the helmet two sets of light emitting diodes (L.E.Ds) arranged in a triangular formation. The sensing means comprises, generally, two independent linear arrays of light-sensitive charge-coupled devices, each of which is sensitive to the radiation emitted by at least one set of L.E.Ds.

The helmet line of sight is determined when the pilot sights a target through a reticle fixed on the helmet's visor. Computing means coupled to the sensors is programmed to determine the helmet line of sight from a knowledge of the positions on the two sensors of the three L.E.Ds of at least one set of L.E.Ds. In this context, the helmet line of sight corresponds to the direction of a line joining a fixed point of origin on the helmet with the reticle.

There are several disadvantages with such a system. Owing to the fact that each sensor is linear, means must be provided for determining which particular L.E.D. is being imaged and, to avoid ambiguity, either L.E.Ds of different frequency must be employed or the angular positions of the L.E.Ds must be sensed one at a time. The former solution demands that frequency discrimination means be associated with the sensors whilst the latter assumes that the time interval between the angular positions of successive L.E.Ds being sensed by the two sensors is sufficiently small that the helmet remains substantially stationary during this time interval.

A further disadvantage with such a system is the requirement to provide two independent sensors. Additionally, such a system is intended to measure the angular displacement only of the helmet whereas it would be preferable to determine all six spatial coordinates of the line of sight of an object, corresponding to the three directional coordinates, as well as the three cartesian coordinates of the reference point of the line of sight.

SUMMARY OF THE INVENTION

It is an object of the present invention to provide an improved helmet line of sight measuring system which overcomes some or all of the disadvantages associated with hitherto proposed systems.

According to the invention there is provided a helmet line of sight measuring system for determining the spatial location of a helmet and the line of sight of an observer wearing said helmet, both relative to a coordinate reference frame, said system comprising:

a plurality of assemblies of light sources distributed on said helmet, each assembly comprising three light sources positioned at the vertices of a triangle and a fourth light source outside the plane of said triangle, optical means fixed in space relative to said coordinate reference frame for imaging the light emitted by the light sources in at least one of said assemblies onto an area image sensor producing two-dimensional image data of said light sources on said image sensor plane, and computing means coupled to said area image sensor for determining the spatial coordinates of said helmet from said image data.

In such a system, the line of sight of the observer determined when the observer sights an object through a reticle located on the helmet's visor is a function of the angular displacement of the helmet relative to an initial reference coordinate system. Having sighted the object through the reticle, the observer activates the computing means manually by operating suitable switching means.

Preferably, the light sources are L.E.Ds which emit intra-red radiation when energized. The L.E.Ds are miniature components which thereby function as point sources of radiation; and, furthermore, emit high intensity radiation making them well adapted for use in helmet sight measuring systems.

The optical means are located at a fixed position relative to the area image sensor and to the body of the vehicle in which the invention is utilized. Thus the image distance from the optical means to the area image sensor remains constant whilst the object distance from the light sources on the helmet to the optical means will vary as the observer moves his head. Under these circumstances, the optical means will not necessarily produce a sharply focussed image of the L.E.Ds on the area image sensor, and it is a feature of the invention that the optical image need not be focussed.

The area image sensor may be any two-dimensional array of photoelectric elements such as, for example, a charged-coupled device (C.C.D.). By using a two-dimensional image sensor, an image will be formed in the plane of the image sensor comprising three bright spots positioned at the vertices of a triangle whose relative locations may be correlated to the corresponding L.E.Ds on the helmet. Such correlation is used by the computing means to compute the possible line(s) of sight of the observer. Using the image of only three L.E.Ds on the helmet there will not always exist a unique solution for the line of sight. The provision of the fourth L.E.D. outside of the plane of the other three, removes this ambiguity and enables a unique solution to be computed.

If only a single assembly of light sources were provided on the helmet, there could exist positions of the helmet for which the optical means would be unable to produce an image of the light sources on the area image sensor. To avoid the possibility of such a "blind spot", several assemblies of light sources, as described, are distributed on the helmet such that, for any position of the helmet, at least one such assembly will be capable of generating an image on the area image sensor.

Thus, the invention provides an improved system for measuring the line of sight of an observer, using a single area image sensor on which is generated, simultaneously, images of at least one assembly of four light sources fixed to the helmet.

BRIEF DESCRIPTION OF THE DRAWINGS

One embodiment in accordance with the present invention as applied to a helmet line of sight measuring system for use by an aircraft pilot, with reference to the accompanying drawings in which.

DETAILED DESCRIPTION OF THE INVENTION

Figure 1:
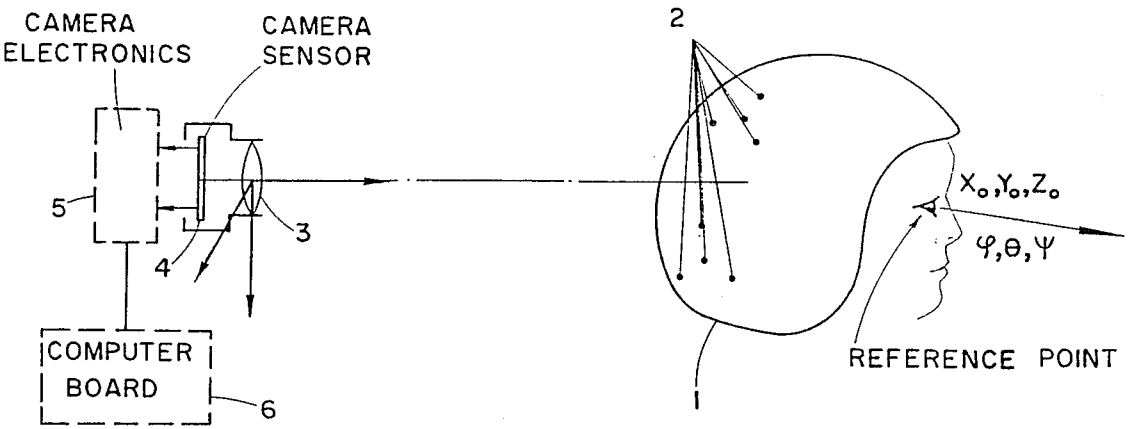
FIG. 1 is a pictorial representation of a helmet line of sight measuring system in accordance with the invention.

Referring to FIG. 1, there is shown a helmet 1 on which are positioned several assemblies 2 of L.E.Ds. Each assembly 2 comprises three L.E.Ds arranged in a triangular formation and a fourth L.E.D. positioned outside of the plane of said triangular formation. The positioning of the various assemblies 2 on the helmet 1 is such that at every instant of time at least one assembly will be in line with optical means 3 which produces an image of each L.E.D. in the assembly onto a C.C.D./C.I.D. area image sensor 4. There will thus be generated on the area image sensor 4 a two-dimensional image corresponding to each of the L.E.D. light sources of the assembly 2. The area image sensor 4 is coupled to suitable camera electronics 5 whose function is to determine the coordinates of the imaged L.E.Ds within the plane of the image sensor 4. The output from the camera electronics 5 is fed to a computer 6 which is programmed to compute from these four pairs of planar coordinates the line of sight of the pilot. The camera electronics 5 and the computer 6 are standard components such as are well-known in the art and will not, therefore, be described in further detail. It is also assumed that people skilled in the art will be able to program the computer 6 so as to compute the desired line of sight of the observer.

Figure 2:
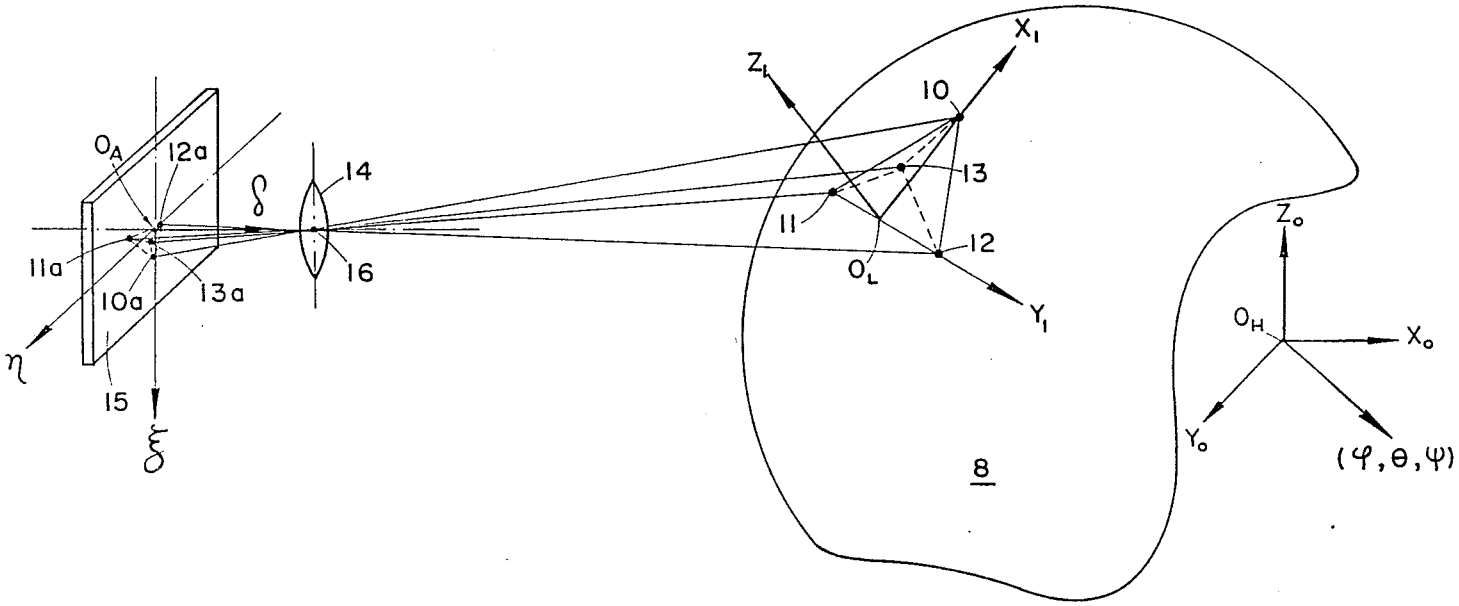
FIG. 2 shows a ray diagram illustrating a method of producing an image on the area image sensor.

FIG. 2 shows in more detail the basis on which such a program may be designed. There is shown a helmet 8, customized for a pilot and with which there is associated a helmet reference coordinate system with origin $O_H$ and cartesian axes $X_O$, $Y_O$ and $Z_O$. Preferably the origin $O_H$ corresponds to the centre of a reticle provided on the visor of the helmet and through which the pilot looks in order to locate a target. Having identified a suitable target through the reticle, the line of sight of the target may then be referred to the origin $O_H$ of the helmet reference coordinate system by means of spherical coordinates ($\phi$, $\theta$, $\psi$).

Shown on the helmet 8 is an assembly of L.E.Ds wherein L.E.Ds 10, 11 and 12 are arranged at the vertices of a triangle and a fourth L.E.D. 13 is arranged outside the plane of this triangle. Associated with the L.E.D. assembly is a local reference coordinate system with an origin $O_L$ and cartesian axes $X_1$, $Y_1$ and $Z_1$.

Optical means 14 situated between the helmet 8 and the area image sensor 15 produce on the plane of the area image sensor 15 images 10*a*, 11*a*, 12*a* and 13*a* corresponding to the L.E.Ds 10, 11, 12 and 13, respectively. The area image sensor 15 is fixed in space relative to the aircraft whose reference coordinate system is denoted in FIG. 2 by origin $O_A$ and cartesian axes $\xi$, $\eta$ and $\delta$.

The coordinates of the images 10*a*, 11*a*, 12*a* and 13*a* on the area image sensor 15 can thus be determined with respect to the aircraft reference coordinate system, origin $O_A$. Since it is arranged that the origin $O_A$ of the aircraft reference coordinate system lies within the plane of the image sensor 15, the $\delta$ coordinate of the image points is equal to zero. The area image coordinates, therefore, correspond to four pairs of planar coordinates ($\xi_{10}$, $\eta_{10}$), ($\xi_{11}$, $\eta_{11}$), ($\xi_{12}$, $\eta_{12}$) and ($\xi_{13}$, $\eta_{13}$). These four coordinate pairs are fed to the computer 6 which is thereby able to compute the coordinates ($X_O$, $Y_O$, $Z_O$) of the origin $O_H$ of the helmet reference coordinate system and the direction of the line of sight ($\phi$, $\theta$, $\psi$).

The computer calculates the line of sight by using a knowledge of the planar coordinates of the image points 10*a*, 11*a* and 12*a* of the area image plane corresponding to the triangularly disposed L.E.Ds, 10, 11, and 12 on the helmet, together with a knowledge of the coordinates of the centre 16 of the lens 14 to reconstruct the pyramid defined by the intersection at the centre of the lens 14 of the beams of radiation emitted by the L.E.Ds 10, 11 and 12. By comparing the relative sizes of the image triangle as defined by images 10*a*, 11*a* and 12*a* to those of the triangularly disposed L.E.Ds 10, 11 and 12, respectively, the computer is able to determine the spatial coordinates of the triangle defined by L.E.Ds 10, 11 and 12 on the helmet 8 relative to the aircraft reference coordinate system. This permits a reconstruction of the local reference coordinate system ($X_1$, $Y_1$, $Z_1$) whose origin $O_L$ and disposition is known and predetermined with respect to the helmet reference coordinate system origin $O_H$. Hence, by means of a simple transformation, the coordinates ($X_O$, $Y_O$, $Z_O$) of the origin $O_H$ of the helmet reference coordinate system and the direction of the line of sight ($\phi$, $\theta$, $\psi$) may be calculated relative to the aircraft reference coordinate system ($\xi$, $\eta$, $\delta$) and origin $O_A$.

Figure 3:
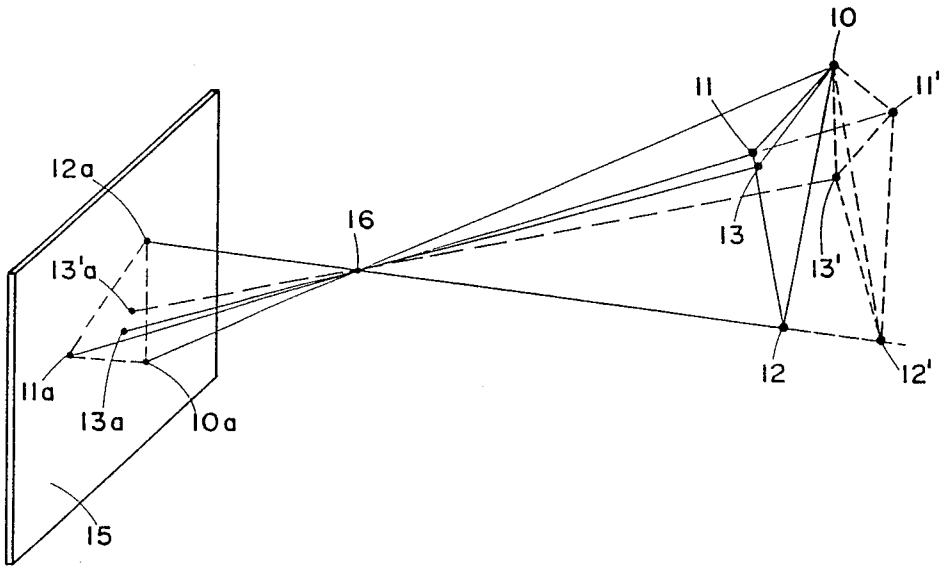
FIG. 3 is a ray diagram illustrating the function of the fourth L.E.D. in the present invention.

Reference will now be made to FIG. 3 which shows schematically the need for the provision of a fourth L.E.D. 13 outside the plane of the triangularly disposed L.E.Ds 10, 11 and 12. As was explained above with reference to FIG. 2, the computer algorithm operates by first reconstructing the pyramid defined by the intersection of the beams of light from the triangularly disposed L.E.Ds 10, 11 and 12 and their point of intersection through the centre 16 of the lens. The lengths of each side of the triangle formed by L.E.Ds 10, 11 and 12 is predetermined according to their fixed positions on the helmet. Hence, the next stage of the computer algorithm is to reconstruct the triangle formed by the L.E.Ds 10, 11 and 12 within the bound by the reconstructed pyramid. However, it is not possible under all circumstances to determine a unique triangle within this pyramid. In FIG. 3 is shown a situation wherein two identical triangles (10, 11, 12) and (10, 11', 12') can be constructed within the same pyramid.

It is to avoid this ambiguity that the fourth L.E.D. 13 is provided outside of the plane of the triangle formed by L.E.Ds 10, 11 and 12. The fourth L.E.D. is shown as 13 for the correctly reconstructed triangle and a 13' for the incorrectly constructed triangle. These L.E.Ds will be imaged as 13*a* and 13*a*', respectively, in the plane of the area image sensor 15. Therefore, from a knowledge of the coordinates of the image point 13*a* within the plane of the image sensor 15, the unique determination of the correct triangle corresponding to L.E.Ds 10, 11 and 12 may be guaranteed.

The determination of the coordinates ($X_O$, $Y_O$, $Z_O$) of the origin $O_H$ of the helmet reference coordinate system in addition to the direction of the line of sight ($\phi$, $\theta$, $\psi$) is required in order to compute the direction of the line of sight vector through the reference point corresponding to origin $O_H$. Additionally, its determination provides a means of eliminating canopy distortion which arises on account of the varying curvature of the aircraft canopy. This varying curvature causes light transmitted to the pilot's eyes to be refracted to differing extents from different points of the canopy. The present invention therefore affords a method of removing the inaccuracies which such distortion would otherwise produce.

Although the invention has been described with reference to the use of L.E.D. light sources for imaging predetermined points on the helmet, any other construction may be employed in order to achieve this objective. In particular, it is possible to provide reflecting symbols on the surface of the helmet which are adapted to reflect a primary light source located within the aircraft on to the area image sensor.

We claim:

1. A helmet line of sight measuring system for determining the spatial location of a helmet and the line of sight of an observer wearing said helmet, both relative to a coordinate reference frame, said system comprising:

a plurality of assemblies of light sources distributed on said helmet, each assembly comprising three light sources positioned at the vertices of a triangle and a fourth light source outside the plane of said triangle, there being a predetermined geometry associated with said light sources;

optical means fixed in space relative to said coordinate reference frame for imaging the light emitting by the light sources in at least one of said assemblies onto an area image sensor located a predetermined distance from said optical means producing two-dimensional image data of said light sources on said area image sensor; and computing means coupled to said area image sensor and responsive to said predetermined geometry and said predetermined distance for determining the spatial coordinates of said helment from said image data.

2. A system in accordance with claim 1, wherein said light sources are infra-red radiation emissive light emitting diodes (L.E.Ds).

3. A system in accordance with claim 1, wherein said light sources are constituted by light reflecting symbols which are adapted to reflect a primary light source located external to said helmet.

4. A system in accordance with claim 1, wherein said area image sensor is a charge-coupled device (CCD).

5. A system in accordance with claim 1, wherein said computing means is programmed to reconstruct the location of said triangle relative to an aircraft reference coordinate system and thence to determine the coordinates of the origin of a helmet reference coordinate system with respect to which the line of sight is then computed.

6. A system in accordance with claim 5, wherein said origin of said helmet reference coordinate system is arranged to be the centre of a reticle provided on the helmet's visor.

* * * * *